US008444291B2

(12) United States Patent
Swan et al.

(10) Patent No.: US 8,444,291 B2
(45) Date of Patent: May 21, 2013

(54) LED ILLUMINATING DEVICE FOR USE DURING TACTICAL OPERATIONS, AND METHOD

(75) Inventors: Johnny E. Swan, Virginia Beach, VA (US); Andrew C. Borland, Virginia Beach, VA (US)

(73) Assignee: S&S Precision, LLC, Virginia Beach, VA (US)

( * ) Notice: Subject to any disclaimer, the term of this patent is extended or adjusted under 35 U.S.C. 154(b) by 336 days.

(21) Appl. No.: 12/592,327

(22) Filed: Nov. 23, 2009

(65) Prior Publication Data

US 2010/0128470 A1 May 27, 2010

Related U.S. Application Data

(60) Provisional application No. 61/199,959, filed on Nov. 21, 2008.

(51) Int. Cl.
*F21L 4/04* (2006.01)

(52) U.S. Cl.
CPC ..... *F21L 4/04* (2013.01)
USPC . 362/205; 362/191; 362/249.02; 362/249.05; 362/249.12; 362/190

(58) Field of Classification Search
USPC ..... 362/190, 191, 200, 205, 249.02, 362/249.05, 249.12, 800
See application file for complete search history.

(56) References Cited

U.S. PATENT DOCUMENTS

| | | | | |
|---|---|---|---|---|
| 1,107,040 | A | | 8/1914 | Conde |
| 1,610,092 | A | | 10/1924 | Hise |
| 2,236,736 | A | | 9/1938 | Scott |
| 2,296,287 | A | | 9/1942 | Leyde |
| 2,346,695 | A | | 4/1944 | Miller |
| 2,545,419 | A | | 3/1951 | Williams |
| 2,837,630 | A | | 6/1958 | Shen |
| 2,972,739 | A | | 2/1961 | Opper |
| 3,155,297 | A | | 11/1964 | Stumpf |
| 3,348,746 | A | | 10/1967 | Stumpf |
| 3,769,663 | A | | 11/1973 | Perl |
| 3,834,052 | A | | 9/1974 | Steck, III |
| 3,908,950 | A | | 9/1975 | Apel |
| 4,008,536 | A | | 2/1977 | Adams |
| 4,216,600 | A | | 8/1980 | Brueckner et al. |
| 4,462,064 | A | * | 7/1984 | Schweitzer ..... 362/105 |
| 4,504,001 | A | | 3/1985 | Nichols |
| 4,639,944 | A | | 2/1987 | Lashley et al. |
| 4,750,656 | A | | 6/1988 | Bianchi et al. |
| 4,777,754 | A | | 10/1988 | Reynolds, Jr. |

(Continued)

OTHER PUBLICATIONS

U.S. Appl. No. 29/395,765, Plate Carrier Vest, filed Mar. 27, 2012, Johnny E. Swan and Andrew C. Borland.

(Continued)

*Primary Examiner* — Ismael Negron

(74) *Attorney, Agent, or Firm* — Speed Law Firm

(57) ABSTRACT

An illuminating device has a transparent body including an electronic components section with at least one circuit board, at least one light emitting diode electrically connected to the at least one circuit board, and one or more switching mechanisms electrically connected to the at least one circuit board. The illuminating device is capable of activation, deactivation, and subsequent reactivation by manipulating the one or more switching mechanisms. A method of using the illuminating device, including activating, deactivating, and reactivating the illuminating device by manipulating one or more switching mechanisms.

12 Claims, 6 Drawing Sheets

U.S. PATENT DOCUMENTS 4,797,793 A * 1/1989 Fields ..... 362/105
4,905,396 A 3/1990 Bechtel
4,939,863 A 7/1990 Alexander et al.
5,014,892 A 5/1991 Copeland
5,018,653 A 5/1991 Shoemaker
5,033,219 A 7/1991 Johnson et al.
5,040,322 A 8/1991 Iturrey, Jr.
5,054,170 A 10/1991 Otrusina
5,070,437 A * 12/1991 Roberts, Sr. ..... 362/158
5,122,781 A 6/1992 Saubolle
5,165,782 A * 11/1992 Maglica et al. ..... 362/208
D332,172 S 1/1993 Lewis
5,203,624 A 4/1993 Schier et al.
D340,542 S 10/1993 Marlowe
5,265,781 A 11/1993 Nichols
5,267,131 A * 11/1993 Anthony et al. ..... 362/208
D352,165 S 11/1994 Covertson
5,400,008 A 3/1995 Toohey
5,414,405 A 5/1995 Hogg et al.
5,430,967 A 7/1995 Woodman, III et al.
5,436,814 A 7/1995 Hanley
5,438,494 A 8/1995 Harlan
5,469,346 A 11/1995 Haut et al.
5,564,610 A 10/1996 Barron
5,598,958 A 2/1997 Ryan et al.
5,620,120 A 4/1997 Tien
5,622,297 A 4/1997 Rogers et al.
5,633,623 A 5/1997 Campman
5,639,005 A 6/1997 Chouinard
5,644,792 A 7/1997 Tishler et al.
5,671,561 A 9/1997 Johnson et al.
5,697,695 A * 12/1997 Lin et al. ..... 362/184
5,716,121 A * 2/1998 Dubois ..... 362/198
5,735,594 A * 4/1998 Own ..... 362/202
5,771,489 A 6/1998 Snedeker
5,810,221 A 9/1998 Beletsky et al.
5,839,630 A 11/1998 Dunstan et al.
5,850,954 A 12/1998 Dong-Joo
5,865,524 A * 2/1999 Campman ..... 362/102
5,978,961 A 11/1999 Barker
5,996,115 A 12/1999 Mazelsky
6,012,827 A 1/2000 Caplan et al.
6,059,156 A 5/2000 Lehtinen
6,067,013 A 5/2000 Pejic
6,069,557 A 5/2000 Anglin, Jr. et al.
6,112,448 A 9/2000 Gray et al.
6,148,447 A 11/2000 Bain et al.
6,158,874 A * 12/2000 Brustein et al. ..... 362/184
6,161,741 A 12/2000 French
6,175,958 B1 1/2001 Wu
6,185,854 B1 2/2001 Solinsky et al.
6,190,018 B1 * 2/2001 Parsons et al. ..... 362/116
6,213,623 B1 * 4/2001 Campman ..... 362/202
6,276,088 B1 8/2001 Matthews et al.
D452,047 S 12/2001 Ditchfield et al.
6,371,625 B2 * 4/2002 Campman ..... 362/184
6,393,752 B1 5/2002 Oliver et al.
6,478,441 B2 11/2002 Lam
6,499,245 B1 12/2002 Swan
6,578,311 B2 6/2003 Danielson et al.
6,616,294 B1 9/2003 Henry
6,685,067 B2 2/2004 French
6,742,913 B2 * 6/2004 Deutsch ..... 362/253
6,785,997 B2 9/2004 Oz
6,817,727 B1 11/2004 McFadden
6,910,224 B2 6/2005 Ikenaga et al.
6,955,279 B1 10/2005 Mudd et al.
6,976,777 B1 12/2005 Herold
7,021,790 B2 * 4/2006 Parsons ..... 362/191
7,096,620 B2 8/2006 Zeh
7,156,536 B1 1/2007 McCorkle
7,195,370 B2 * 3/2007 Riblett et al. ..... 362/120
7,218,142 B2 5/2007 Nozawa et al.
7,218,241 B2 5/2007 Kessel et al.
7,226,183 B2 6/2007 Galli et al.
7,267,453 B2 * 9/2007 Chang et al. ..... 362/120
7,287,873 B2 * 10/2007 Galli ..... 362/158
7,395,627 B2 7/2008 La France et al.
7,444,776 B2 11/2008 Adams
7,458,489 B1 12/2008 Mudd et al.
7,517,108 B2 4/2009 Galli et al.
7,523,583 B2 4/2009 Cheng
7,534,006 B2 * 5/2009 Goswami et al. ..... 362/189
7,562,484 B2 7/2009 Kim
7,694,450 B2 4/2010 Keng
7,712,148 B2 5/2010 Carlson
7,735,255 B1 6/2010 Kincaid et al.
7,736,013 B2 6/2010 Griffin
7,743,547 B2 6/2010 Houde-Walter
D622,036 S 8/2010 Mason, III
7,827,724 B1 11/2010 Spinelli
7,836,625 B2 11/2010 Swan et al.
D640,417 S 6/2011 Haynes
D641,960 S 7/2011 Goff et al.
D648,489 S 11/2011 Stockard
D652,573 S 1/2012 Rodriguez
D666,363 S 8/2012 Culbertson
8,256,020 B2 9/2012 Dovner et al.
2002/0096545 A1 7/2002 Chang
2002/0148865 A1 10/2002 French
2003/0090893 A1 * 5/2003 Nepil ..... 362/101
2003/0098323 A1 5/2003 Taylor et al.
2003/0141329 A1 7/2003 Huang
2004/0000083 A1 1/2004 Grant, Jr.
2004/0069821 A1 4/2004 Kobayashi
2004/0145889 A1 * 7/2004 Hendricks ..... 362/109
2005/0010987 A1 1/2005 Crye et al.
2005/0180130 A1 * 8/2005 Harris et al. ..... 362/184
2006/0026888 A1 2/2006 Cheng et al.
2006/0198132 A1 * 9/2006 Trigiani et al. ..... 362/183
2006/0236583 A1 10/2006 Pikielny
2006/0253950 A1 11/2006 Kerr
2007/0079415 A1 4/2007 Carlson
2007/0230162 A1 10/2007 Galli et al.
2008/0205037 A1 8/2008 Griffin
2008/0235841 A1 10/2008 McDunn et al.
2009/0122527 A1 5/2009 Galli
2009/0151036 A1 6/2009 Joseph
2009/0185854 A1 7/2009 Adams
2009/0190332 A1 7/2009 Sharrah
2009/0293334 A1 12/2009 Swan
2010/0018103 A1 1/2010 Holmberg
2010/0192448 A1 8/2010 Darian
2011/0032694 A1 2/2011 Swan
2011/0131694 A1 6/2011 Fearon
2011/0209260 A1 9/2011 Herbener et al.
2011/0231985 A1 9/2011 Bishop
2011/0249432 A1 10/2011 Swan et al.
2012/0030986 A1 2/2012 Swan et al.
2012/0057360 A1 3/2012 Swan

OTHER PUBLICATIONS

U.S. Appl. No. 13/506,182, Plate Carrier Apparatus and Method, filed Apr. 2, 2012, Johnny E. Swan and Andrew C. Borland.

* cited by examiner

LED ILLUMINATING DEVICE FOR USE DURING TACTICAL OPERATIONS, AND METHOD

CROSS-REFERENCE TO RELATED APPLICATIONS

This application claims benefit of U.S. provisional patent application Ser. No. 61/199,959, filed Nov. 21, 2008, which is herein incorporated by reference.

BACKGROUND OF THE INVENTION

1. Field of the Invention

Embodiments generally relate to an illuminating device and method.

2. Description of the Related Art

Currently, military units, law enforcement agencies, civil services, and civilians use chemical snap lights to provide illumination, identify themselves or injured personnel, hazardous areas, and other objects or places of interest. These chemical snap lights are waterproof and have an activated life span of approximately 8-12 hours, depending on the color and intensity of the lights. After being activated, these lights only stay lit for their approximate chemical burn time and then have no purpose and must be disposed of.

A majority of times these lights are only needed for a couple of hours or less, so the ability to turn these lights off and then reuse them would be of great benefit to the end user, decreasing the impact on the environment and providing greater cost savings over time. A benefit would include having the ability to use one light for different situations instead of having to bring multiple chemical snap lights that can only be used once.

Chemical snap lights have been used during night freefall operations to mark individual jumpers and equipment. At high altitudes, the chemical snap lights may become deactivated due to extreme low temperatures. When attached to the parachutist, the chemical snap lights become a snag hazard which may result in parachute malfunction during canopy deployment.

During night parachute operations, parachutists are required to have a visual marking device on the back of their helmet. Therefore, because the current snap lights possess only lights to indicate that they are activated which require visual inspection, it is difficult during the "jump" for the parachutist to determine if his or her marking device is activated or not.

As discussed above, current snap lights do not permit deactivation and subsequent reactivation of the lights. Current snap lights do not possess ergonomic, versatile designs and thus do not allow their facile transfer between equipment and increase the chance of their becoming snag hazards.

There is therefore a need for an illuminating device which allows deactivation and subsequent re-activation of the illuminating device.

There is also a need for an illuminating device which possesses an ergonomic, versatile design which allows for easy transfer between equipment and prevents its becoming a snag hazard.

There is yet a further need for an illuminating device which permits the user to discern whether the illuminating device is activated without requiring visual inspection of the device.

SUMMARY OF THE INVENTION

To this end, embodiments generally include an illuminating device for use during tactical operations, comprising a transparent body having a first end and a second end, the body ergonomically designed for use during tactical operations; an electronic components section disposed within the body comprising at least one circuit board, at least one light emitting diode electrically connected to the at least one circuit board, and one or more switching mechanisms electrically connected to the at least one circuit board, wherein the illuminating device is capable of activation, deactivation, and subsequent reactivation by manipulation of the one or more switching mechanisms. Other embodiments generally include a method of using an illuminating device, comprising providing an illuminating device having a transparent body, the body ergonomically designed for use during tactical operations; an electronic components section disposed within the body comprising at least one circuit board, at least one light emitting diode electrically connected to the at least one circuit board, and one or more switching mechanisms electrically connected to the at least one circuit board; activating the illuminating device by manipulating the one or more switching mechanisms; deactivating the illuminating device by manipulating the one or more switching mechanisms; and reactivating the illuminating device by manipulating the one or more switching mechanisms.

BRIEF DESCRIPTION OF THE DRAWINGS

So that the manner in which the above-recited features of embodiments of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

An object of embodiments is to provide an illuminating device that is capable of being attached to the curvature of a helmet and in the same embodiment is transferrable to MOLLE gear.

Another object of embodiments is to provide an illuminating device with a low profile design that reduces the chance of being snagged once attached to the user's gear.

Yet another object of embodiments is to provide an illuminating device that allows the end user positive tactile feedback when illuminated or not illuminated through, for example, a tactile "clickie" switch and a vibrating motor.

Still another object of embodiments is the ability to turn the illumination device on and off as required.

Another object of embodiments is to fully encapsulate the illuminating device to provide a waterproof and shockproof housing.

Embodiments include an illuminating device for identifying a person or equipment, for example during parachute operations conducted in the dark or at night. Embodiments further include an illuminating device with a novel, versatile, ergonomic design which facilitates transferring of the illuminating device from one surface to another. The novel, versatile, ergonomic design of embodiments also aids in preventing snagging of the device, for example during parachuting operations.

Figure 8:
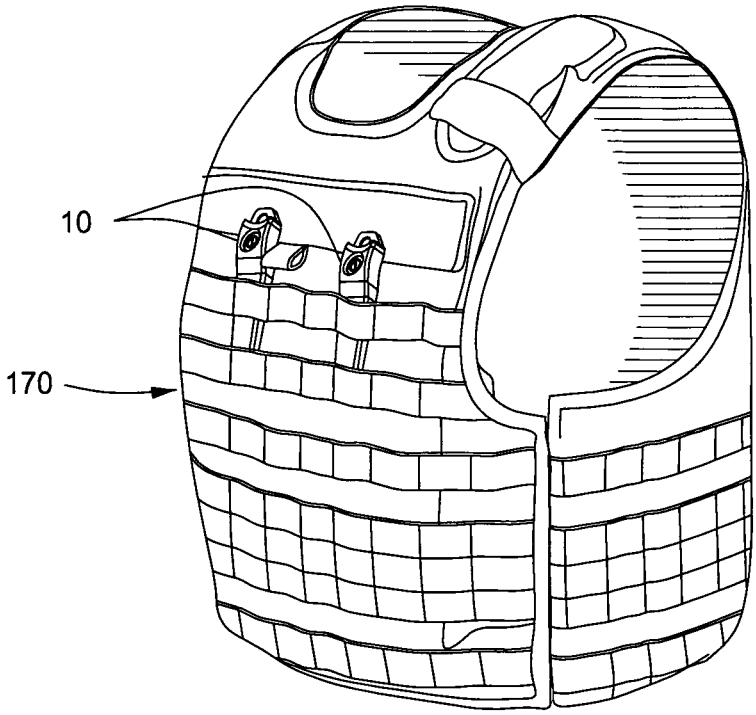
FIG. 8 is a perspective view of the illuminating device of FIG. 1 disposed in slots of a MOLLE system.

In some embodiments, the novel design of the illuminating device allows the user to transfer the illuminating device between a location atop a helmet (see, e.g., FIG. 9) and location secured within one or more slots of Modular Lightweight Load bearing Equipment ("MOLLE") sewn tactical load bearing equipment (see, e.g., FIG. 8). Furthermore, the illuminating device is easily transferred to and from other equipment and surfaces, including tactical equipment. Embodiments address the need for an ergonomically-designed shape of illuminating device which fits on top of a helmet's curve (see FIG. 9) and easily in the user's equipment.

Embodiments further address the need for the user to have the ability to determine whether the illuminating device is illuminated without visual inspection of the device.

In some embodiments, the illuminating device may be used for tactical parachute operations to safely provide nighttime identification (or identification in the dark) of personnel and equipment.

Additionally, the flexibility of the material of the illuminating device body (e.g., silicone rubber material) allows the illuminating device to be operatively attached to the convex shape of a parachutist's helmet or other type of helmet. Attaching the illuminating device to the helmet provides a low profile protrusion from the helmet, thus reducing the hazard of parachute lines or other parachute parts snagging on the illuminating device upon parachute deployment.

Embodiments provide a light emitting diode marking system that may be completely encapsulated within a translucent silicon rubber body (although other similar materials for the body are within the scope of embodiments, as described below). This process of manufacturing may provide an extremely rugged and flexible waterproof housing. The body has a shape and texture that provides a medium for the light waves to be refracted through and along its longitudinal axis, which may illuminate the invention entirely.

The illuminating device of embodiments is an ideal tactical marking device for military and law enforcement units or an ideal emergency/safety marking device for outdoor recreational activities. In embodiments, the illuminating device utilizes its ergonomic design and multiple attachment methods to make it both versatile and user friendly.

A benefit of the illuminating device is that it gives the end user the control of being able to activate or deactivate (and reactivate) the illumination source when desired. In embodiments, the illuminating device is rugged, flexible and may be waterproof. The illuminating device may be used multiple times and may perform more than one color or light sequence operation.

As shown in FIGS. 1-9, embodiments include an illuminating device 10 (which may also be termed a V-Lite™) having a main body 20 which may be disposed in an optional housing 30. The main body 20 includes a first end 20A and a second end 20B. In some embodiments, the first end 20A is the upper end of the illuminating device 10 when it is in use.

Figure 5:
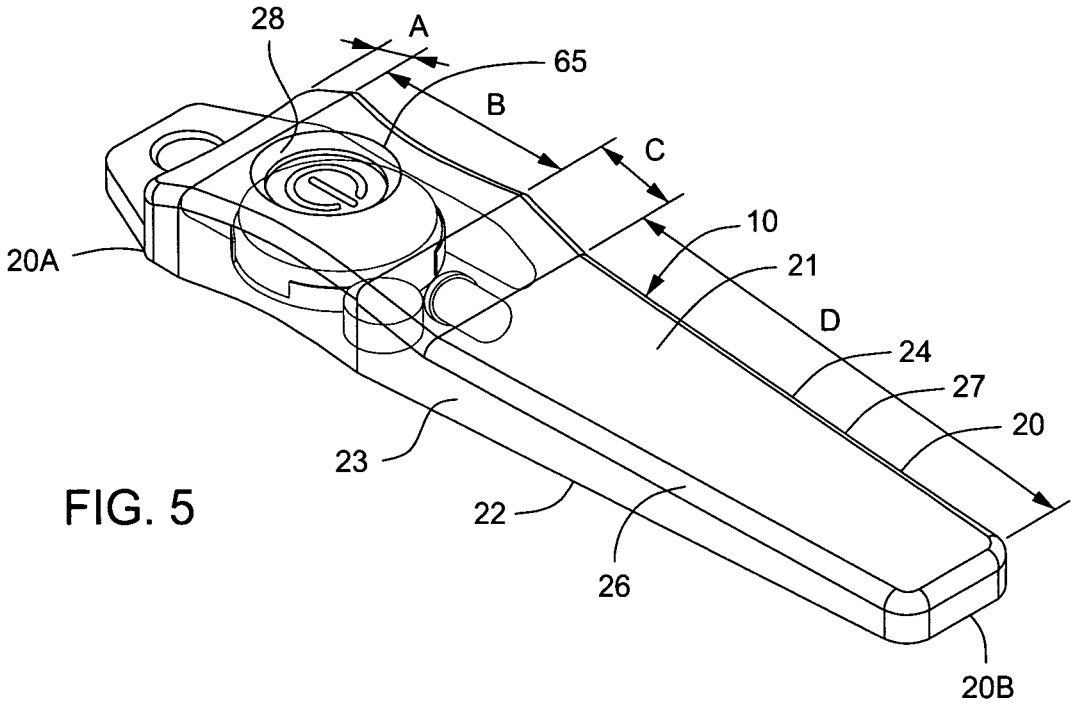
FIG. 5 is a perspective view of the illuminating device of FIG. 1.
Figure 6:
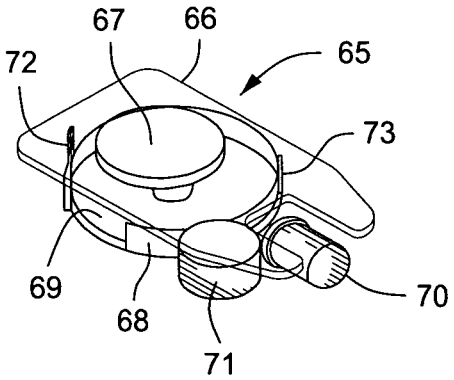
FIG. 6 is a perspective view of a circuit board for the illuminating device of FIG. 1.

The illuminating device 10, including the main body 20, is shown in FIG. 5. Generally, the illuminating device 10 uses its ergonomic design and multiple attachment methods and functioning capabilities to make it both versatile and user friendly.

The body 20 may be transparent and made of flexible silicone and/or other similar materials. The body 20 conforms to an ergonomically-designed shape that fits on top of a helmet's curved portion (see FIG. 9, for example) or in the end user's equipment. The flexibility of embodiments of the body 20 allows the illuminating device 10 to be securely attached to the convex shape of a helmet, such as a parachutist's helmet or tactical helmet 160 shown in FIG. 9. Additionally, the same illuminating device 10 is capable of multiple uses and is versatile, as the illuminating device is shaped to fit within the slots of Modular Lightweight Load bearing Equipment ("MOLLE"), such as the MOLLE 170 found on most modern tactical load bearing equipment. During ground operations, the illuminating device 10 is also capable of functioning as a marking device during ground operations.

One embodiment of the body 20 is depicted in FIG. 5. The body 20 may include an upper surface 21, lower surface 22, first side surface 23, second side surface 24, first connecting surface 26 for connecting the upper surface 21 with the first side surface 23, and second connecting surface for connecting the upper surface 21 with the second side surface 24.

As shown in FIG. 5, the ergonomic design of the illuminating device 10 may include sections of the body 20 having different slopes, widths, heights, and/or curves. Section A may include a sloped surface (with respect to height) as shown in FIG. 5, section B may include an upwardly curved surface which is of a smaller width than thee width of section A, section C may include a downwardly sloped height which is of the same or smaller width than the widest portion of section B, and section D may include a tapered width as it reaches the second end 20B and a downwardly sloped height. In some embodiments, Sections A through D, together, have a length of approximately 4 inches. However, any dimensions of the illuminating device 10 are within the scope of embodiments, and especially any dimensions of the illuminating device 10 which permit its fitting into the MOLLE system 170.

Sections C-D of the illuminating device are designed to fit (by sliding) into the MOLLE system 170 (see FIG. 8) by having a width that is less than the slots of the MOLLE system 170. A lower end of Section B is designed to have a width larger than the slots of the MOLLE system 170 to act as a stop shoulder for the illuminating device 10 when the illuminating device 10 is placed in the slots. Section B and the housing 30 are also designed so that the retaining members 50 and 55 (see description of housing 30 below) are disposed at the upper and lower ends of the electronic components section 65.

The sections A-D may be separately formed and securely attached to one another or may be molded together in one unitary piece.

In embodiments, the illuminating device 10 may provide a light emitting diode ("LED") marking system which is completely (or at least substantially) encapsulated within a flexible, translucent body 20 which may be made of silicone or other similar materials. The body 20 has a shape and texture that provides a medium for the light waves to be refracted through and along its longitudinal axis, which illuminates the illuminating device 10 entirely.

Disposed within the body 20 is an electronics component section 65. The electronic components section 65 is preferably secured at a location within the body section B and encapsulated (completely or at least substantially) within the body section B, but may instead be disposed at any location within the body 20. The electronic components section 65 includes a circuit board 66 (printed circuit board "PCB") having multiple components electrically connected thereto. One or more specific colors may be added to the surface of the PCB 66 by any method known to those skilled in the art for coloring a circuit board, such as by silk-screening.

One or more LEDs 70 are electrically connected to the PCB 66. The LED(s) 70 may include one or more single-color LEDs and/or one or more multi-color LEDs. The circuit board 66 may be colored, such as by silk-screening, to match the color of the LED(s) 70 of the illuminating device 10, thereby providing a visual indicator for the end user to discern the LED color of the device 10 without requiring activation of the device 10.

Optionally, one or more vibrating motors 71 or other vibrating mechanisms known to those skilled in the art may be electrically connected to the PCB 66 to allow a user to determine whether the illuminating device 10 is activated (illuminated) by the vibration of the device 10 without requiring visual inspection of the device 10. With the optional vibrating motor 71, the user may determine whether the illuminating device 10 is activated or deactivated or what mode, pattern, or sequence of activation in which the device 10 is operating by touch rather than visual inspection. The vibrating motor 71 may vibrate when the illuminating device 10 is activated (illuminated) and may either not vibrate or vibrate in a different vibration pattern or sequence when the illuminating device is deactivated (not illuminated). The vibrating motor 71 may also include different vibration patterns or sequences when the illuminating device 10 is in a different mode of activation (e.g., different lighting colors or different lighting patterns).

This vibrating motor 71 may be especially useful when the illuminating device 10 is disposed on a helmet (e.g., a parachutist's helmet) or other equipment on the user's body. The tactile switch 67 (described below) and vibrating motor 71 may give the parachutist instantaneous feedback whenever the illuminating device 10 is activated or deactivated atop the parachutist's helmet.

The lighting sequence(s) of the illuminating device 10 are controlled by a microcontroller or microprocessor 80 which is operatively attached to the PCB 66. The microcontroller or microprocessor 80 is the brain of the electronic components and illuminating device 10. The firmware of the microcontroller or microprocessor 80 may be programmed via software. The firmware controls LED blink patterns and rate, LED color patterns, timed shut down sequences, and a variety of other user-specific functions.

Also electrically connected to the circuit board 66 are one or more switches 67. The switch 67 is preferably a positive tactile switch. The switch 67 allows the user to activate the illuminating device 10 (turn it on), deactivate the illuminating device 10 (turn it off), or to select different operating functions from the microcontroller or microprocessor 80. The one or more switches 67 and other electronic components of the illuminating device 10 permit activation and deactivation of the device 10 by the user to turn the light on and off repeatedly for periods of time, rather than requiring multiple single-use lights.

Figure 7:
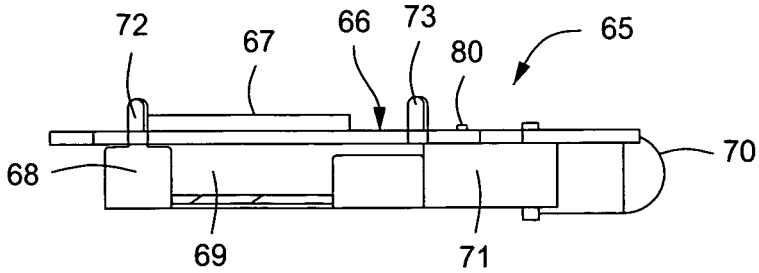
FIG. 7 is a side section view of a portion of the illuminating device.

One or more power sources, such as one or more batteries 69, are electrically connected to the circuit board to power the electronic components of the illuminating device 10. In one embodiment shown in FIG. 7, the power source 69 is located on an opposite side of the circuit board 66 from the switch 67. The power source 69 may be housed by a housing 68 (e.g., a battery housing) which may partially or totally encompass the power source 69. The housing 68 may optionally include one or more tabs 72, 73 which extend along the outer surface of the power source 69 as well as along the outer surface of the PCB 66, for example as shown in FIGS. 7 and 8. Thus, the housing 68 may partially enclose both the power source 69 and the circuit board 66 and maintain their alignment with one another. In one example, the power source 69 is a CR2032 3V power source; however, this example is not limiting of embodiments, and any other type of power source disposable within the body 20 is also within the scope of embodiments. The power source 69 may, in one example, provide the illuminating device 10 with an approximate activated life span of 120 hours, and in another example provide the illuminating device 10 with an approximate activated life span of 36 hours, although any other power source life span is also within the scope of embodiments.

The LED 70 may be programmed to illuminate in multiple colors (e.g., four colors) with just the one LED within one illuminating device 10. A particular color of the multiple colors may be selected by activating the on/off switch 67, giving the user the capability of activating multiple illumination colors with one illuminating device 10. The multi-color ability of the illuminating device 10 eliminates the need for the user to carry multiple lights of different colors.

The illuminating device 10 may be operatively attachable to surfaces and equipment using various attachment means and methods, as described below. The attachment means, members, and methods described below are merely examples and are not limiting of attachment means, methods, and members of the illuminating device 10 to any surface or object. Rather, any attachment means, method, or member of attaching an illuminating device 10 to an object, surface, material, or piece of equipment is within the scope of embodiments.

Figure 3:
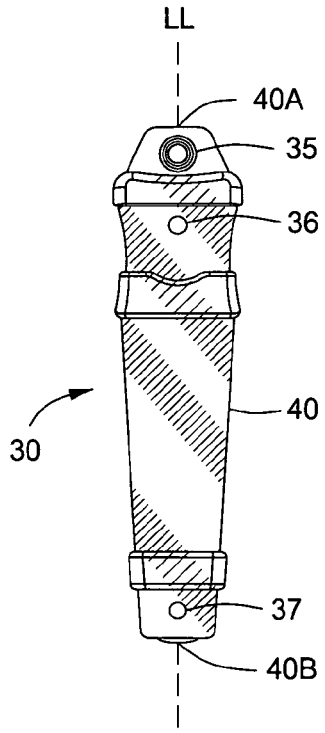
FIG. 3 is a downward view of the illuminating device of FIG. 1 enclosed in the housing.
Figure 4:
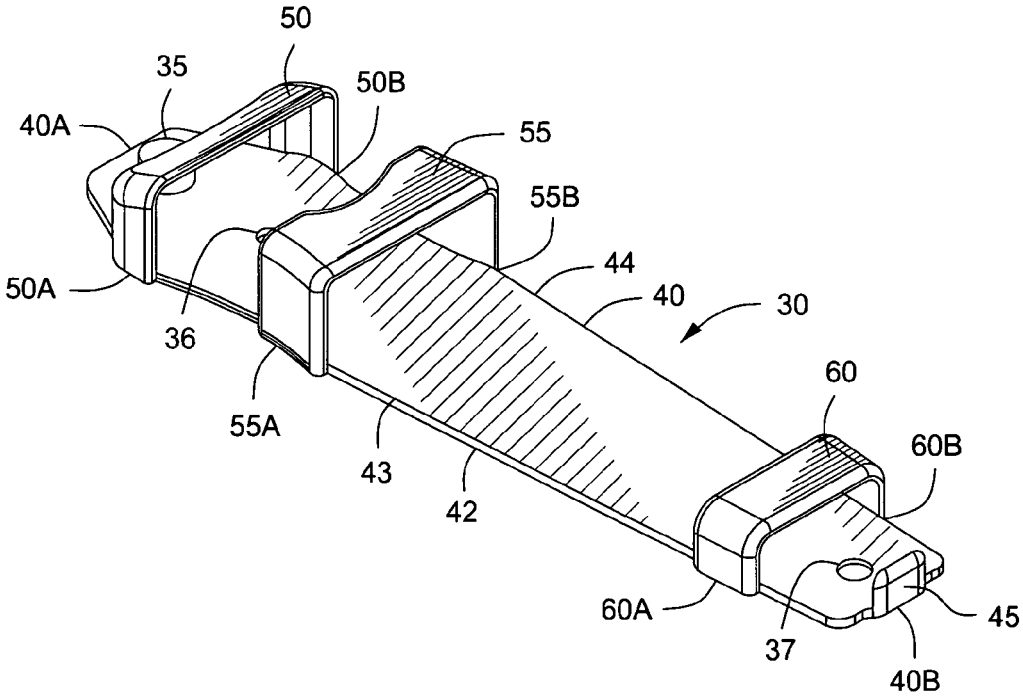
FIG. 4 is a perspective view of the housing of FIG. 1.

FIGS. 3 and 4 illustrate an optional housing 30 for the illuminating device 10. The housing 30 may be utilized to operatively attach the illuminating device 10 to one or more surfaces or pieces of equipment. The housing 30 includes a base 40 having a first end 40A and second end 40B. In some embodiments, the first end 40A is the upper end of the housing 30 when it is in use. One or more optional apertures 35 or other mounting/attachment means or attachment points may be included through the base 40 proximate to the first end 40A of the housing 30. In some embodiments, one or more securing members such as one or more lanyards, rubber bands, strings, cords, keychain rings, belts, and/or small webbing loop slots (not shown) may be extended through the one or more apertures 35 to allow hanging of the housing 30 from a location via the one or more securing members.

The housing 30 may additionally include one or more optional mounting holes 36 and 37 disposed therethrough along a length of the base 40. These mounting holes 36 and 37 may be utilized to mount the housing 30 to a surface or object, for example via one or more connecting or fastening members such as screws or other fasteners disposed through the one or more mounting holes 36 and 37 and through surface or object. In some embodiments, the one or more apertures 35 and one or more mounting holes 36 and 37 are longitudinally generally aligned with one another, where a longitudinal line LL is drawn through a central axis of the base 40 (see FIG. 3).

Figure 1:
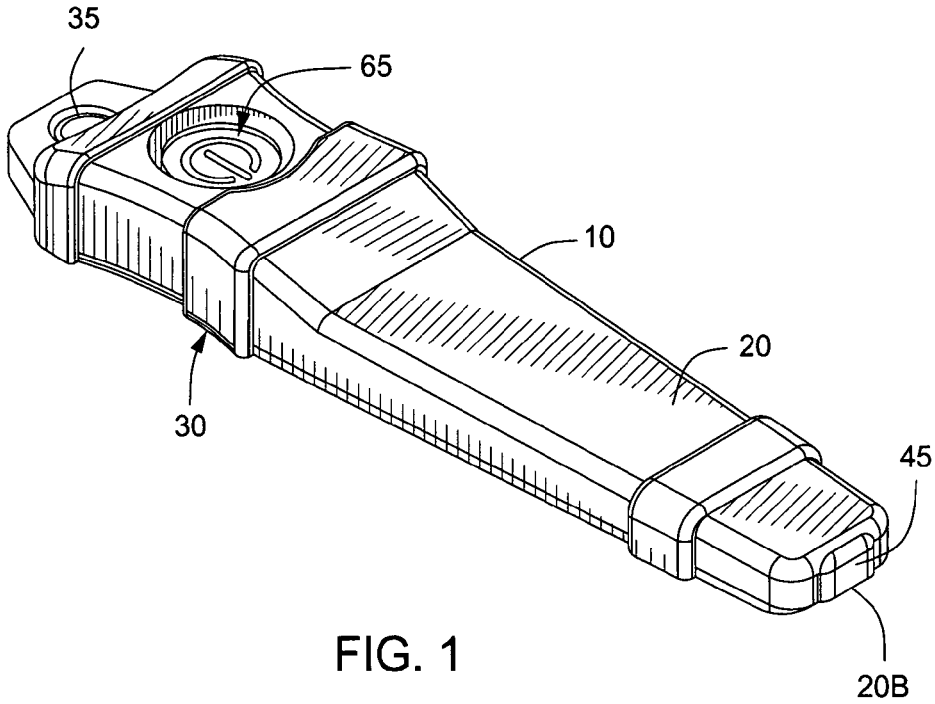
FIG. 1 is a perspective view of an embodiment of an illuminating device enclosed in a housing.
Figure 2:
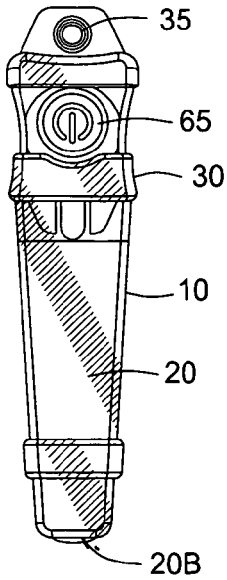
FIG. 2 is a downward view of the illuminating device of FIG. 1 enclosed in the housing.

The base 40 includes an upper surface 41, lower surface 42, first side 43, and second side 44. As shown, the housing 30 is generally configured to house the illuminating device 10 as shown in FIGS. 2 and 3 in particular. As such, the upper surface 41 of the base 40 may be sloped and sized so that the upper surface abuts and conforms to the contours of the lower surface 22 of the body 20 when the illuminating device 10 is disposed in the housing 30.

Extending from the base 40 of the housing 30 are one or more retaining members 50, 55, 60. Shown are a first retaining member 50, a second retaining member 55, and third retaining member 60. The retaining members 50, 55, 60 are designed to generally encapsulate the main body 20 around its width to retain the illuminating device 10 within the housing 30. In one embodiment, the retaining members 50, 55, 60 are each attached at or near their first ends 50A, 55A, 60A to a location at or near a first side 43 of the base 40 and at or near their second ends 50B, 55B, 60B to a location at or near a second side 44 of the base 40. The retaining members 50, 55, 60 may be, in one embodiment, generally U-shaped as shown in FIGS. 1-4. However, the U-shape is only one example of a configuration of the retaining members 50, 55, 60, and they may be of any shape which is capable of retaining the illuminating device 10 securely therein. Similarly, any number of retaining members 50, 55, 60 may be utilized which is capable of securely retaining the illuminating device 10 within the housing 30, including just one or two of the retaining members 50, 55, 60. In the embodiment shown in FIGS. 1-4, the retaining members are spaced longitudinally along the base 40 of the housing 30; however, any other spacing arrangement is also within the scope of embodiments. It is not necessary that the retaining members 50, 55, 60 be attached to the first side 43 and second side 44 if they are sufficiently capable of retaining the illuminating device 10 therein.

The housing 30 may further include an optional shoulder 45 at its second end 40B which extends upward from its second end 40B to provide a stop for the illuminating device 10 when it is disposed in the housing 30. The housing 30 may be an injection molded plastic clip device to provide a secure attachment method.

The housing 30 may include sections which generally conform to the contours of sections A-D of the body 20. Similar to the body 20, the housing sections may be formed separately and attached to one another or may be formed as one unitary piece, e.g., by molding.

Figure 10:
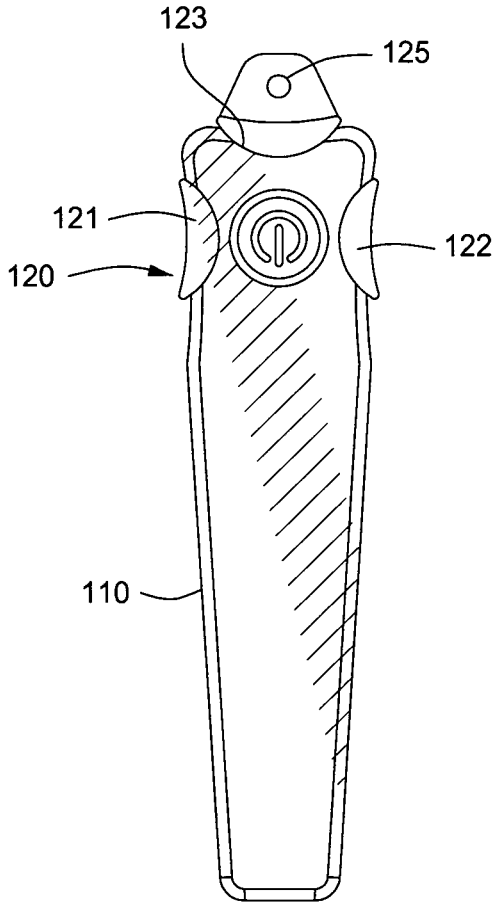
FIG. 10 is a downward view of a second embodiment of an illuminating device and a housing.
Figure 11:
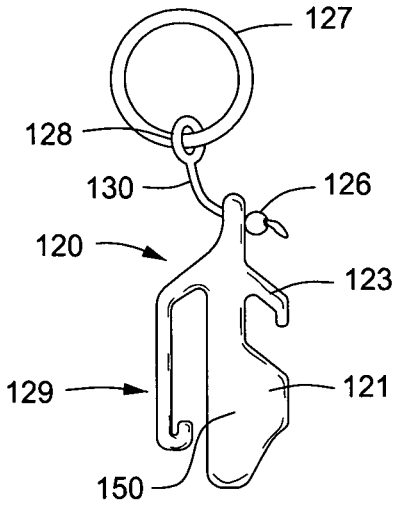
FIG. 11 is a side view of the housing of FIG. 10.
Figure 12:
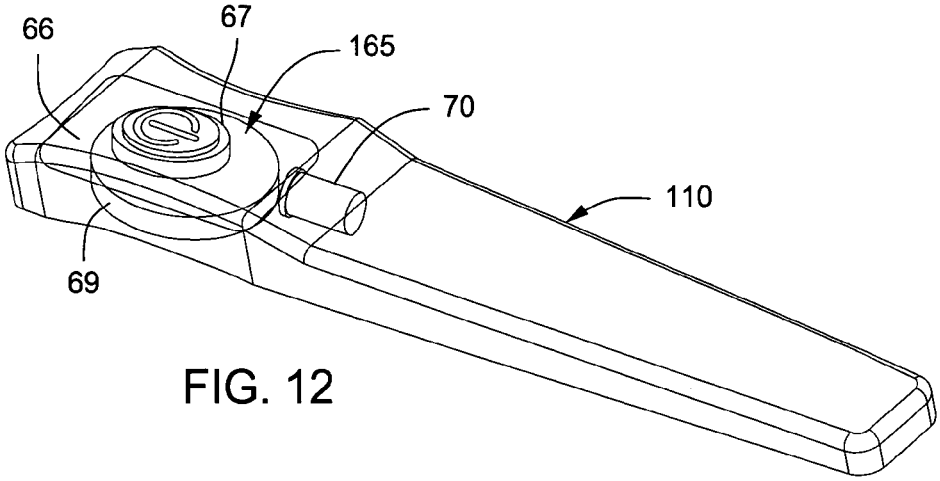
FIG. 12 is a top perspective view of the illuminating device of FIG. 10.

FIGS. 10-16 depict a second embodiment of an illuminating device 110 and optional housing 120 for attaching the illuminating device 110 to a surface or object. The housing 120 may include a clip device as shown in FIGS. 10 and 11. The clip device may, for example, comprise injection molded plastic or any other material capable of grasping the illuminating device 110 therein and providing a means and method of operative, secure attachment of the illuminating device 110 to an object, surface, or material.

The housing 120 is an optional accessory that grasps around the electronics components section of the illuminating device 110. This clip device 120 may be employed to provide the user with a secure attachment method of the illuminating device 110 to a surface, object, equipment, or material. The clip device 120 may include a body 150 having one or more attachment points such as one or more apertures 125 therein for looping one or more objects therethrough such as one or more rubber bands, strings, cords, chains, keychain rings, belts, rings, and/or small webbing loop slots. Shown in FIG. 11 is a loop member 130 extending through the aperture 125, with the loop member 130 including a break away rubber loop 128 and a rubber ball breakaway system 126. The rubber ball breakaway system 126 acts as a stop for the loop member 130 movement with respect to the aperture 125 in at least one direction, and the breakaway rubber loop 128 permits another object to be looped through the breakaway rubber loop 128, such as a keychain 127.

The housing 120 may extend from an upper end of the illuminating device 110 along at least a portion of the length of the housing 120. As shown in FIGS. 10 and 11, the housing 120 may include one or more first retaining members or claws 123 which are capable of retaining an upper portion of the illuminating device 110 within the housing 120, one or more second retaining members or claws 121 which are capable of retaining a first side portion of the illuminating device 110 within the housing 120, and one or more third retaining members or claws 122 which are capable of retaining a second side portion of the illuminating device 110 within the housing 120. The claw 123 is disposed at or near an upper end of the base 150, the claw 121 is disposed at or near a first side portion of the base 150, and the claw 122 is disposed at or near a second side portion of the base 150. The retaining members 123, 122, 121 cooperate to retain an upper portion of the illuminating device 110 within the housing 120. The illuminating device 110 is removable from and insertable into the housing 120 by manipulation of the claws 121, 122, 123 to release or retain the illuminating device 110 therein.

The housing 120 may also include other attachment members, means, or methods, such as one or more belt clips 129 to allow clipping of the illuminating device 110 to the user's belt via the housing 120. The housing 120 may include other attachment members, means, or methods known to those skilled in the art, such as one or more apertures through the housing 120 for placing one or more fasteners therethrough.

The illuminating device 110 includes an electronic components section 165 similar to the electronic components section 65 described above, as shown in FIGS. 10 and 12-16.

Another attachment means and method for the illuminating device includes the MOLLE system 170. The body 20 may include a low profile shape as depicted in the figures, which is purposely angled and formed to slide into the existing MOLLE system 170, as depicted in FIG. 8. The MOLLE system (MOLLE=Modular Lightweight Load bearing Equipment) 170 may consist of one or more rows of heavy-duty nylon or other similar material stitched in intervals that allows attachment of various pouches and accessories thereto. MOLLE systems are used by military and other federal and domestic law enforcement agencies. FIG. 8 shows a vest MOLLE system.

Figure 9:
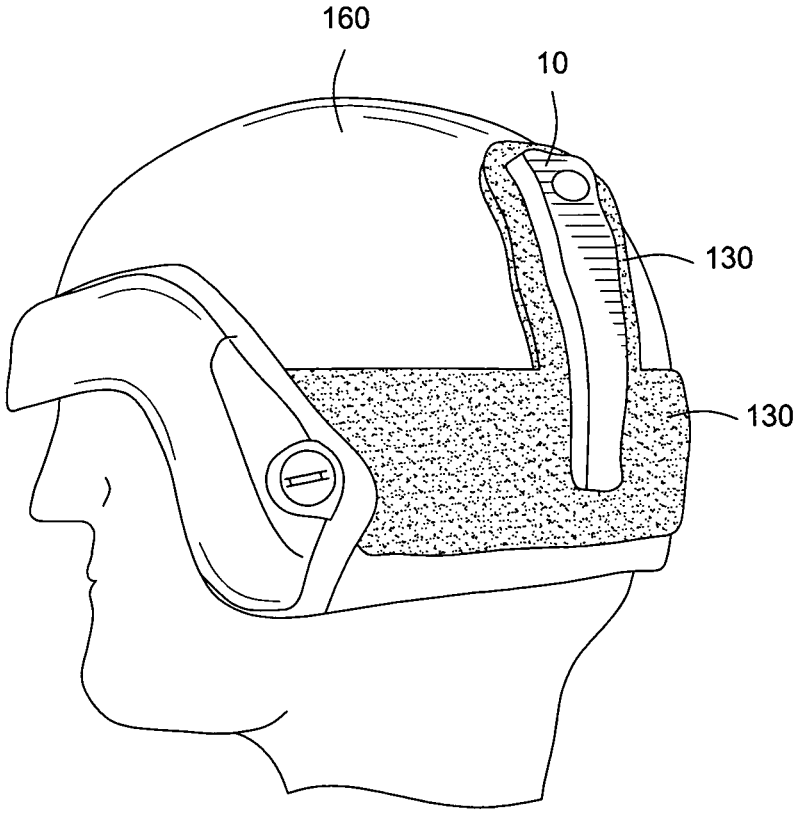
FIG. 9 is a perspective view of the illuminating device of FIG. 1 disposed on a tactical helmet.

The illuminating device 10 may also be capable of being attached to any surface using one or more fasteners such as one or more hook and loop fasteners 130, also known by the commercial name Velcro®, or using any other attachment device or method known to those skilled in the art (preferably, although not necessarily, the attachment means/method allows repeated removal and replacement of the illuminating device 10 on the helmet 160). With a precut piece of Velcro® that may generally match the shape of the profile of the illuminating device 10, the illuminating device 10 may be operatively attached to the curved surface of a tactical ballistic helmet, parachuting helmet, or other helmet 160, as shown in FIG. 9. This application is of particular importance because it indicates the flexibility of the device, therefore overcoming the challenge of providing illumination along and around a convex compound-curved surface. This attachment means and method permits the operative attachment of the illuminating device 10 to the back of a parachutist's helmet, limiting the chance of the light becoming a snag hazard for the parachutist.

The illuminating device 10 and housing 20 design allows for easy transition of the illuminating device 10 to and from the helmet and the slots of the MOLLE found on most modern tactical load bearing equipment. For example, when the parachutist reaches the ground, the illuminating device 10 may be transitioned from the helmet into the slots of the MOLLE. The same illuminating device 10 may become a marking device during ground operations.

Figure 13:
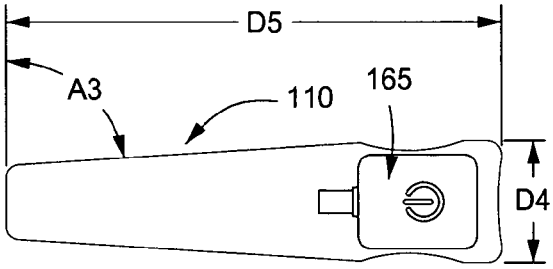
FIG. 13 is a top view of the illuminating device of FIG. 10.
Figure 15:
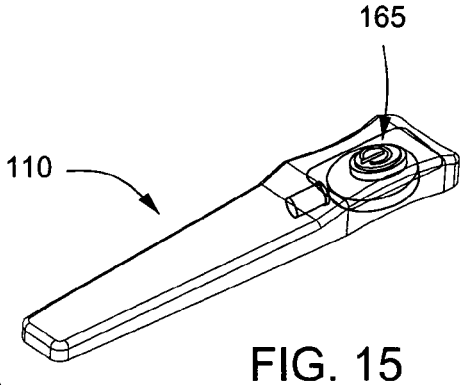
FIG. 15 is a top perspective view of the illuminating device of FIG. 10.
Figure 14:
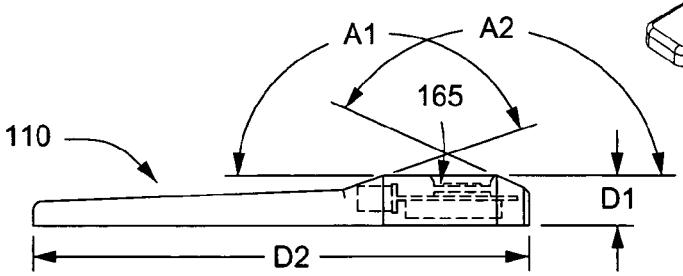
FIG. 14 is a side view of the illuminating device of FIG. 10.
Figure 16:
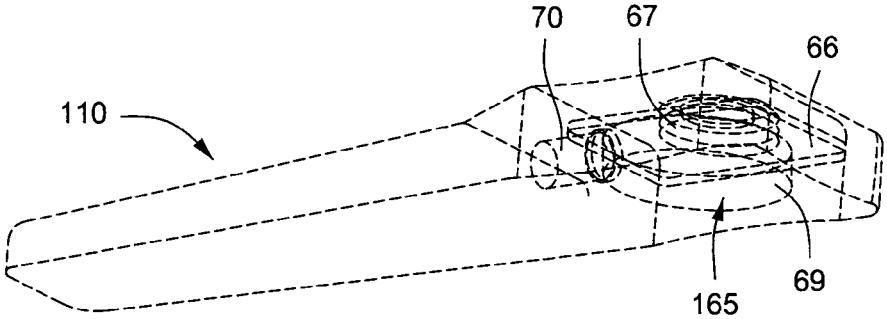
FIG. 16 is a top perspective view of the illuminating device of FIG. 10, showing the components within the illuminating device.

For purposes of illustration, FIGS. 13 and 14 depict various dimensions of an exemplary illuminating device 110. The same or similar dimensions may be utilized for the illuminating device 10 of the embodiment shown in FIGS. 1-7. Some exemplary dimensions which are not limiting of dimensions which may be utilized for the illuminating device 110 are a first end width D4 of approximately 1 inch, a length D2 and D5 of approximately 4 inches, a height D1 of approximately 0.4 inches, an angle A3 of approximately 86 degrees, an angle A2 of approximately 163 degrees, and an angle A1 of approximately 159 degrees. In some embodiments, the length D2 and D5 of the illuminating device 10 or 110 may be in a range of approximately two inches to approximately 8 inches, the width of the device 10 or 110 may be in a range of approximately 0.5 inches to approximately 2 inches, and the height of the device 10 or 110 may be in a range of approximately 0.4 inches to approximately 2 inches, although any dimension ranges are within the scope of embodiments.

In operation, the illuminating device 10 may be activated by manipulating the one or more switching mechanisms 67. Manipulating the switch 67 activates the LED 70 and the vibrating motor 71 through the circuit board 66. To deactivate the LED 70 and the vibrating motor 71, the switch 67 may be manipulated in the opposite manner or a different manner. The illuminating device 10 may be reactivated and deactivated as desired during the battery life of the device 10.

To attach the illuminating device 10 to one or more surfaces, objects, materials, etc., the housing 30 may be used to house the device 10 (e.g., slide the device 10 into the housing 30) and then the housing 30 may be attached to the surface, object, or material for example via screws through the apertures 36, 37 or by the belt clip 129, or any other attachment device, means, or method.

The illuminating device 10 may also be inserted into the MOLLE system 170 slots and/or attached by hook and loop fasteners 130 or other attachment means, methods, or members to the helmet 160. When attaching the device 10 to the helmet 160, the hook and loop fasteners 130 are attached to the helmet 160, for example via adhesive on one side of the fasteners 130. Hook and loop fasteners are also attached to a lower surface of the device 10, for example via adhesive. The hook and loop fasteners on the helmet and the hook and loop fasteners on the device 10 are placed in contact with one another to attach the device 10 to the helmet 160. The device 10 is also removable and re-attachable to the helmet 160 (or other surface, object, material, etc.).

While the foregoing is directed to embodiments of the present invention, other and further embodiments of the invention may be devised without departing from the basic scope thereof, and the scope thereof is determined by the claims that follow.

The invention claimed is:

1. An illuminating device for use during tactical operations, comprising:

a transparent body having a first end and a second end, the body having a smooth and substantially continuous shape;

an electronic components section disposed within the body comprising:

at least one circuit board, at least one light emitting diode electrically connected to the at least one circuit board, and one or more switching mechanisms electrically connected to the at least one circuit board, wherein the illuminating device is capable of activation, deactivation, and subsequent reactivation by manipulation of the one or more switching mechanisms, further comprising one or more vibrating motors electrically connected to the at least one circuit board.

2. The illuminating device of claim 1, wherein manipulation of the one or more switching mechanisms activates or deactivates the one or more vibrating motors to indicate activation or deactivation of the light emitting diode.

3. A system, comprising:

an illuminating device, comprising:

a transparent body having a first end and a second end, the body having a smooth and substantially continuous shape and at least one generally flat surface to allow secure attachment of the body to a surface of tactical equipment, and an electronic components section disposed within the body comprising:

at least one circuit board, at least one light emitting diode electrically connected to the at least one circuit board, and one or more switching mechanisms electrically connected to the at least one circuit board, wherein the illuminating device is capable of activation, deactivation, and subsequent reactivation by manipulation of the one or more switching mechanisms; and the surface, wherein the body of the illuminating device provides a low profile protrusion from the surface when it is secured to the surface, wherein the body is flexible to allow the flat surface of the body to be substantially similar in curvature to the surface of the tactical equipment to which it is secured.

4. The system of claim 3, wherein the flat surface of the body is attached to the surface of the tactical equipment using one or more fasteners.

5. An illuminating device for use during tactical operations, comprising:

a transparent body having a first end and a second end, the body having a smooth and substantially continuous shape and at least one generally flat surface to allow secure, low profile attachment of the body to one or more surfaces; and an electronic components section disposed within the body comprising:

at least one circuit board, at least one light emitting diode electrically connected to the at least one circuit board, and one or more switching mechanisms electrically connected to the at least one circuit board, wherein the illuminating device is capable of activation, deactivation, and subsequent reactivation by manipulation of the one or more switching mechanisms, and wherein the body comprises a first section between second and third sections of the body, the first section having decreased width with respect to the second and third sections.

6. The illuminating device of claim 5, further comprising a housing for grippingly engaging the illuminating device and providing an attachment medium for the illuminating device to the one or more surfaces, wherein one or more clipping mechanisms are disposed on the housing to operatively attach the housing to the one or more surfaces and the one or more clipping mechanisms clip the illumination device at the first section of the body.

7. A system, comprising:

an illuminating device, comprising:

a transparent body having a first end and a second end, the body having a smooth and substantially continuous shape and at least one generally flat surface to allow secure attachment of the body to a surface of tactical equipment, and an electronic components section disposed within the body comprising:

at least one circuit board, at least one light emitting diode electrically connected to the at least one circuit board, and one or more switching mechanisms electrically connected to the at least one circuit board, wherein the illuminating device is capable of activation, deactivation, and subsequent reactivation by manipulation of the one or more switching mechanisms; and the surface, wherein the body of the illuminating device provides a low profile protrusion from the surface when it is secured to the surface, wherein the surface is an outside of a helmet, the helmet is a parachuting helmet, and the body is designed to provide a low profile protrusion from a convex shape of the parachuting helmet.

8. An illuminating device for use during tactical operations, comprising:

a transparent body having a first end and a second end, the body having a smooth and substantially continuous shape and at least one generally flat surface to allow secure, low profile attachment of the body to one or more surfaces; and an electronic components section disposed within the body comprising:

at least one circuit board, at least one light emitting diode electrically connected to the at least one circuit board, and one or more switching mechanisms electrically connected to the at least one circuit board, wherein the illuminating device is capable of activation, deactivation, and subsequent reactivation by manipulation of the one or more switching mechanisms, further comprising a housing for grippingly engaging the illuminating device and providing an attachment medium for the illuminating device to the one or more surfaces, wherein one or more apertures are disposed through the housing to operatively attach the housing to the one or more surfaces, and further comprising a loop member extending through the one or more apertures, the loop member comprising a break away loop and ball breakaway system which acts as a stop for loop member movement in at least one direction with respect to the one or more apertures.

9. A method of using an illuminating device, comprising:

providing an illuminating device having a flexible, transparent body, the body having a generally smooth and substantially continuous surface;

an electronic components section disposed within the body comprising:

at least one circuit board, at least one light emitting diode electrically connected to the at least one circuit board, and one or more switching mechanisms electrically connected to the at least one circuit board;

activating the illuminating device by manipulating the one or more switching mechanisms;

deactivating the illuminating device by manipulating the one or more switching mechanisms; and reactivating the illuminating device by manipulating the one or more switching mechanisms.

10. The method of claim 9, further comprising:

disposing the illuminating device within one or more slots of modular lightweight load bearing equipment, wherein a shape of the body allows a first portion of the body to rest within the one or more slots and a second portion of the body to provide a stop shoulder for maintaining the illuminating device within the one or more slots;

removing the illuminating device from the one or more slots;

manipulating a curvature of the flexible body to generally conform to a convex portion of a helmet; and operatively connecting the illuminating device to the convex portion of the helmet.

11. The method of claim 9, further comprising operatively connecting the illuminating device to a convex surface by manipulating the flexible body to conform to the curvature of the convex surface and operatively attaching it to the surface, wherein activating or reactivating the illumination device provides illumination along and around the convex surface.

12. The method of claim 9, further comprising attaching at least one generally flat surface of the body to one or more generally flat surfaces.

* * * * *